313-414 SR
9/21/82 OR 4,350,923

United States Patent [19]
Hughes

[11] 4,350,923
[45] Sep. 21, 1982

[54] ELECTRON GUN WITH BALANCED LENS LIPS TO REDUCE ASTIGMATISM

[75] Inventor: Richard H. Hughes, Lancaster, Pa.

[73] Assignee: RCA Corporation, New York, N.Y.

[21] Appl. No.: 134,641

[22] Filed: Mar. 27, 1980

[51] Int. Cl.³ ..... H01J 29/50
[52] U.S. Cl. ..... 313/414; 313/458
[58] Field of Search ..... 313/414, 458

[56] References Cited

U.S. PATENT DOCUMENTS 3,772,554 11/1973 Hughes ..... 313/414
3,890,528 6/1975 Say et al. ..... 313/414
3,936,692 2/1976 Izumida et al. ..... 313/414
3,987,328 10/1976 Yoshida et al. ..... 313/414
4,086,513 4/1978 Evans ..... 313/414
4,234,814 11/1980 Chen et al. ..... 313/412

*Primary Examiner*—Eli Lieberman
*Attorney, Agent, or Firm*—E. M. Whitacre; G. H. Bruestle; D. H. Irlbeck

[57] ABSTRACT

A 3-beam in-line electron gun comprises a pair of tub-shaped lens electrodes, each of which has three in-line apertures in its floor with tubular lips extending from the periphery of the apertures into the tubs. The lips of the lower voltage electrode are longer than the corresponding lips of the higher voltage electrode by an amount designed to either balance out the astigmatism of the fringe focus fields within the tubs or perferably to completely reverse the polarity of the overall astigmatism to at least partially compensate for the astigmatism of a self-converging yoke used with the gun.

4 Claims, 6 Drawing Figures

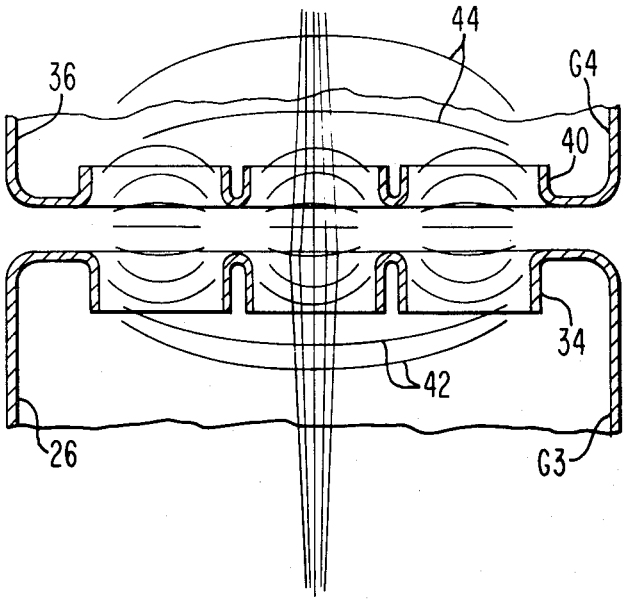
Fig. 2.
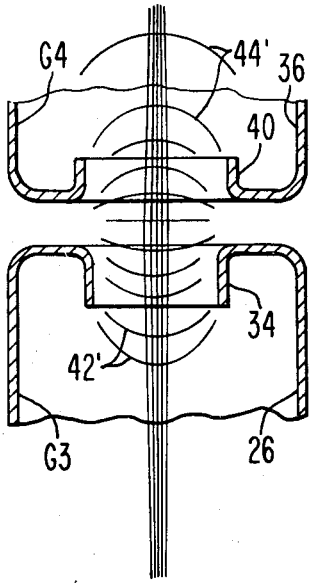
Fig. 3.
| | SOURCE OF FIELD | CENTER SPOT | CORNER SPOT |
|---|---|---|---|
| a | PRIOR ART LENS ALONE | ◇ | ◇ |
| b | YOKE ALONE | ○ | ◇ |
| c | PRIOR ART LENS + YOKE | ◇ | ◇ |
| d | NOVEL LENS ALONE | ○ | ○ |
| e | NOVEL LENS ALONE | ◇ | ◇ |
| f | NOVEL LENS (d) + YOKE | ○ | ◇ |
| g | NOVEL LENS (e) + YOKE | ◇ | ◇ |
Fig. 4.

| G4 LIP IN mm | G3 LIP IN mm | RATIO G4 LIP/G3 LIP | CENTER SPOT SHAPE |
|---|---|---|---|
| 2.54 | 2.54 | 1.0 | ◇ |
| 1.905 | 2.54 | 0.75 | ○ |
| 2.54 | 6.096 | 0.417 | ○ |
| 1.143 | 2.54 | 0.45 | ◁▷ |

ELECTRON GUN WITH BALANCED LENS LIPS TO REDUCE ASTIGMATISM

This invention relates to electron guns for cathode ray tubes and particularly to focus lens electrodes of unitized in-line guns used with self-converging yokes in color television systems.

BACKGROUND OF THE INVENTION

Modern cathode ray tube systems, for displaying color images for home television, may include an electron gun designed to generate three in-line beams disposed in a common horizontal plane and a self-converging deflection yoke designed to maintain the beams converged as they are scanned over the screen of the tube. In such a system the deflection field of the yoke is inherently astigmatic by design so as to obtain its self-converging characteristic. However, this astigmatism, which desirably produces the self-convergence, at the same time undesirably produces a distortion on the cross-sectional shape of the electron beams. Specifically, the yoke field is over-converging in the vertical plane and under-converging in the horizontal plane. Thus, if the electron gun is arranged to produce a circular beam spot at the center of the screen, the spot will become horizontally elongated with a vertically extending flare or smear when it is scanned to the corners of the screen.

In the in-line self-converging system described above, it has been common practice to provide the electron gun as a unitized structure, that is, one in which the three beams are acted upon by common electrodes which have three separate apertures therein. This type of structure contributes to accuracy and relative rigidity between the electron beam forming structures for each of the three beams. In such guns it is common to provide certain of the electrodes, for example, those between which the main focus lens of the gun is formed, in the form of elongated cups with the electron beam apertures formed in mutually facing floors of the cups. These cups, because of their elongated bathtub-like shape, are often referred to as tubs. These tub electrodes, in addition to having three in-line apertures in the floors of the tubs, also have tubular lips around the apertures which extend into the interiors of the tubs.

I have discovered that the focus fields established between these tub electrodes extend completely through the cylindrical lips surrounding the apertures and that the fringe portions of the three separate fields then merge into a single field which spans the entire length and width of the tub electrodes. These fringe portions of the fields are of much shallower curvature in the elongated direction of the tub electrode than in the orthogonal short direction of the tub. As a result, the fringe field formed in the interior of the tub beyond the ends of the aperture lips is astigmatic, and like that of the self-converging yoke field is over-converging in the vertical plane and under-converging in the horizontal plane, thus further contributing to undesirable beam spot distortion.

SUMMARY OF THE INVENTION

I have now discovered that in an electron gun of the type described above, the astigmatism inherent in the fringe fields in such tub electrodes having in-line apertures can be adjusted by adjusting the relative lengths of the tubular aperture lips. For example, by elongating the lips in the low-voltage portion of the lens and/or by shortening the lips in the high-voltage portion of the lens, the astigmatism in the lens can be essentially balanced out. Furthermore, by a proper adjustment of the relative lip lengths in the two electrodes, the polarity of the lens astigmatism can be reversed to at least partially compensate for the astigmatic effects of the self-converging yoke field on the shape of the electron beam spots.

BRIEF DESCRIPTION OF THE DRAWINGS

FIGS. 2 and 3 are section views taken in orthogonal planes of portions of the electron lens electrodes of the electron gun of FIG. 1 illustrating the focus fields thereof.

FIG. 4 is a chart illustrating electron beam spot shapes resulting from various sources of electron focusing or deflection fields.

DETAILED DESCRIPTION OF THE PREFERRED EMBODIMENT

Figure 1:
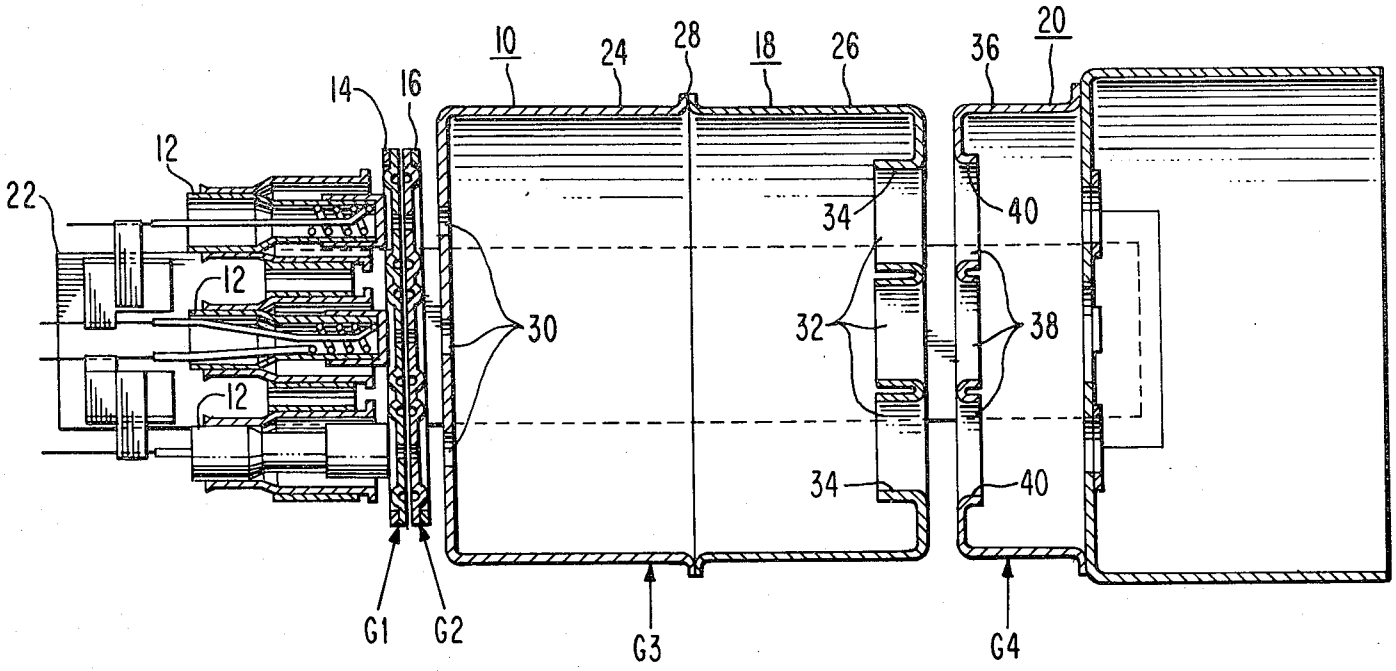
FIG. 1 is a longitudinal section of a novel 3-beam in-line electron gun embodying the invention.

FIG. 1 illustrates an electron gun 10 incorporating one embodiment of the invention. Except for novel modifications, as hereinafter described, the electron gun 10 may be of the 3-beam in-line type similar to that described in U.S. Pat. No. 3,772,554 issued to R. H. Hughes on Nov. 13, 1973, and incorporated by reference herein for the purpose of disclosure.

The electron gun 10 comprises three tubular in-line cathodes 12, a control grid (G1) 14, a screen grid (G2) 16, and two lens electrodes consisting of a focus electrode (G3) 18 and an accelerating electrode (G4) 20. The cathodes, grids, and lens electrodes are mounted in predetermined spaced relationship on a pair of insulator support rods 22. The G1, G2, G3, and G4 are each provided with three in-line apertures aligned with the three cathodes through which three co-planar in-line electron beams are projected.

The lens electrode G3 comprises a pair of tub-shaped cups 24 and 26 joined together at their open ends 28. The tubs 24 and 26 have a dimension from top to bottom as shown in FIG. 1 which is significantly longer than the dimension of the tubs in the direction perpendicular to the plane of the drawing. The tub 24 is provided with three simple apertures 30 in the floor of the tub through which electron beams enter the G3 electrode. The tub 26 is provided with three relatively larger apertures 32 in its floor through which the electron beams exit from the G3 electrode. The exit apertures 32 are provided with tubular lips 34 which extend inwardly into the interior of their associated tub 26.

The lens electrode G4 also includes a tub-shaped element 36 having three apertures 38 therein which face the three apertures 32 of the G3 electrode. In a similar manner, the G4 apertures 38 have tubular lips 40 which project inwardly into the interior of their associated tub 36.

The G3 lips 34 are significantly longer than the G4 lips 40, with the ratio of their lengths being designed to adjust the astigmatism of the focus fields established within the G3 and G4 as hereinafter described.

In the operation of the electron gun 10, the main focus field for each electron beam is established between and within the G3 and G4. FIGS. 2 and 3 illustrate these portions of the G3 and G4 in horizontal and vertical axial planes respectively. In these figures the focus fields established by the two electrodes are illustrated by a series of equipotential lines which depict the general shape and location of the focus fields.

Although the focus fields are established principally within and between the electrode lips 34 and 40, the fringe portions of the fields nevertheless do extend through these lips and into the interiors of the G3 and G4. These fringe portions, which extend beyond the lips 34 and 40, merge from their three separate fields within the lips into a single field illustrated by the equipotential lines 42 in the G3 and 44 in the G4, as shown in the axial horizontal plane (in-line plane) of FIG. 2. The equipotential lines of corresponding potentials in the orthogonal vertical plane of FIG. 3 are shown as equipotential lines 42' in the G3 and 44' in the G4. Because the dimensions of the electrode tubs 26 and 36 are longer in the horizontal plane, as illustrated in FIG. 2, than they are in the vertical plane, as illustrated in FIG. 3, the curvatures of the equipotential lines 42 and 44 in the horizontal plane are much less than are the curvatures of the equipotential lines 42' and 44' in the vertical plane. The result is that both the G3 fringe field 42–42' and the G4 fringe field 44–44' are astigmatic, in that each is stronger in the vertical plane than in the horizontal plane.

The astigmatism of the G3 fringe field and the astigmatism of the G4 fringe field are present in both prior art lens designs and lens designs of the present novel gun 10, and furthermore are present notwithstanding the relative lengths of the electrode lips 34 and 40. This is because these astigmatisms exist due to the elongated cross-sections of the tub-shaped electrodes used for unitized 3-beam in-line electron guns.

As is well know, a simple bipotential electron lens, whether accelerating or decelerating, has entrance and exit portions on opposite sides of a transverse central plane (e.g. a transverse mid-plane between G3 and G4 in the gun 10) with one portion acting to converge electron rays of a beam and the other portion acting to diverge the rays. Furthermore, if these two portions are of equal field strength, as is conventional, the net effect of the lens will always be convergent. This is so because the convergent portion of the lens will always be on the lower voltage side of the lens where the electron velocities are less, thereby resulting in the electrons being subjected to its convergent actions for a longer period of time than they are to the divergent action of the other portion.

According to the present teaching the lenses are made unequal on opposite sides of the G3–G4 mid-plane so that although the anastigmatic field portions within the lips 34 and 40 have a net convergence to provide beam focusing, the astigmatic fringe portions beyond the lips are either balanced out to produce a zero fringe field or else are made to have a desirable astigmatism of reverse polarity, i.e., an astigmatism which over-converges in the horizontal plane.

If the G3 and G4 are provided with equal length lips, as is most common in the prior art, the fringe fields 42–42' and 44–44' are of similar shape and equal strengths, thus resulting in a net astigmatism which produces less focusing action in the horizontal plane than in the vertical plane. Specifically, the astigmatic fringe fields cause the net effect of the focus lenses to be over-focusing or over-converging in the vertical plane and under-focusing or under-converging in the horizontal plane. This difference of focusing action in the two planes produces an electron beam spot which has an elliptically shaped high density core that is of greater horizontal dimension than vertical dimension, but which has a vertically extending lower density area, both above and below the elliptically shaped core. Such an electron beam shape is illustrated in FIG. 4, Item "a", and exists at both the center of the screen of the tube and at the corner of the screen.

I have discovered that I can selectively weaken the vertically convergent G3 fringe field 42–42' relative to the vertically divergent G4 fringe field 44–44' by lengthening the G3 lips 34 relative to their corresponding G4 lips 40. By so lengthening the G3 lips 34, more of the total G3 field is contained within the G3 lips where it is symmetrically shaped, and that fringe portion of the total field, which extends beyond the lips, as illustrated by the equipotential lines 42 and 42', is less than it otherwise would be. Consequently the convergent astigmatic portion of the G3 field is weakened relative to the divergent astigmatic portion of the G4 field. By a judicious selection of relative lengths of the G3 lips 34 and G4 lips 40, this selective weakening of the convergent G3 astigmatism can be made such as to just balance out the G4 divergent astigmatism or can be even further lessened to produce a net overall divergent astigmatism.

As shown in FIG. 4, Item "a", a typical prior art lens having substantially equal length lips on both the G3 and G4 electrodes produces an electron beam spot both at the center and at the corner of the screen which is over-converged in the vertical direction. the spot shapes produced by such a lens are elliptical with horizontal elongation. The triangular smears or tails extending above and below the elliptical core of the spot is of lower electron density and referred to as flare.

FIG. 4, Item "b", illustrates the typical spot shapes produced by a self-converging yoke field. This assumes an electron beam of circular cross section is projected into the yoke field. Since at the center of the screen there is no deflection field applied to the beam, the beam remains of circular cross section. However, at the corner of the screen where the deflection field is strongest, the electron beam has been over-converged vertically in a manner similar to that provided by a typical prior art lens. This is shown to be elongated in the horizontal direction with the typical flare above and below the elliptical core. The yoke field actually applies a vertical over-convergence to the electron beam that may be 10 to 12 times stronger or more severe than that caused by the astigmatic fringe field of a typical prior art lens. This is ilustrated in FIG. 4, Item "b", with the elliptical core of the corner spot being flatter than is the Item "a" core.

FIG. 4, Item "c", illustrates the electron beam spot when it is subjected to both a prior art lens and a self-converging yoke. This is simply a matter of adding the distortions created by each. Since both the prior art lens and the yoke produce vertical over-convergence in the same polarity, the distortion at the corner produced by the combination of these two is even further exaggerated, particularly the flare portions of the spot.

FIG. 4, Item "d", illustrates the shape of the electron beam spot which is provided with one embodiment of the novel electron gun 10. As there shown, the spot shapes are made circular. This is done by a judicious adjustment of the lengths of the G3 and G4 electrode lips 34 and 40 so as to completely eliminate or balance out the astigmatic fringe fields.

FIG. 4, Item "e", illustrates the resulting beam spots of an alternative embodiment of the novel gun 10. Here the G3 lips 34 and G4 lips 40 are adjusted in a predetermined ratio so as to actually go beyond a balancing of the astigmatic fringe fields and produce an astigmatism which is of opposite polarity to that experienced by a prior art lens having equal length G3 and G4 lips. The effect of such an over-balancing is to produce electron beam spots at both the center and the corner of the screen which are over-converged in a horizontal direction, thus providing a vertically elongated elliptical core with horizontally extending flares.

FIG. 4, Item "f", illustrates the combination of the novel electron gun of Item "d" with a self-converging yoke. The result is a circular center spot and vertically over-convergent corner spot. The vertical over-convergence is equal to that produced by the yoke alone, as illustrated in FIG. 4, Item "b".

FIG. 4, Item "g", illustrates the results of combining the novel electron lens of Item "c" with the typical self-converging yoke. Here, the center spot is horizontally over-converged and the corner spot is vertically over-converged. However, because of the opposite polarity of the astigmatisms of the lens and yoke fields, the distortion of the corner spot is significantly reduced from that produced by the yoke alone (Item "b").

Figures 5, 6:
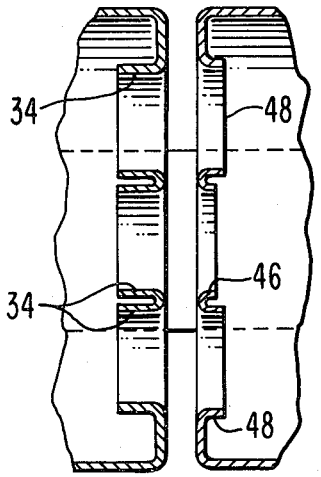
FIG. 5 is a chart illustrating different electron beam spot shapes for different lens lip ratios in electron guns of the type disclosed herein.
FIG. 6 is a section view of the lip portions of a modification of the lens electrodes of the novel electron gun of FIG. 1.

FIG. 5 illustrates the manner in which lip length variations affect spot shape. The examples disclosed in FIG. 5 are for the novel gun 10 having the following significant parameters:

G3 axial length: 23.500 mm
Diameter of G3 aperture 32: 5.436 mm
Diameter of G4 aperture 38: 5.776 mm
G3–G4 spacing: 1.270 mm
Length of G3 tub 26: 22.098 mm
Width of G3 tub 26: 9.906 mm
Length of G4 tub 36: 22.098 mm
Width of G4 tub 36: 9.906 mm
Voltage on G3: 7000 volts
Voltage on G4: 25000 volts FIG. 5, Example "a", is a typical prior art electron gun in which the G3 and G4 lips are equal in length, that is with a G4:G3 lip length ratio of 1.0. The resulting spot shape at the center of the screen has a horizontally elongated elliptical core with flare above and below the elliptical core. This, of course, as hereinbefore described, is the result of over-convergence in the vertical plane.

FIG. 5, Example "b", comprises a G3 lip 2.54 mm long and a G4 lip 1.905 mm long. This results in a G4:G3 lip length ratio of 0.75 and essentially produces a balancing of the convergent astigmatic G3 fringe field and the divergent astigmatic G4 fringe field to provide a circular beam spot.

FIG. 5, Example "c", also produces balanced fringe fields and circular beam spots, but with longer lips than those of Example "b". In Example "c" the G3 lip is 6.096 mm long and the G4 lip is 2.54 mm long, giving a G4:G3 lip length ratio 0.417. A comparison of Example "b" and "c" reveals that as the lengths of the lips are increased, the G4:G3 lip length ratio must be decreased in order to get the same degree of astigmatism balancing or cancellation. This is because the astigmatic fringe fields are weaker overall when greater length lips are used, since more of the total field is contained symmetrically within the lips. Thus, a greater lip length differential must be employed in order to obtain the same absolute value of astigmatism change. This design parameter, illustrated here for circular beam spots, is equally applicable for both vertically over-converged elliptical beam spots and horizontally over-converged elliptical beam spots.

FIG. 5, Example "d", comprises a G3 lip length of 2.54 mm and a G4 lip length of 1.143 mm, giving a G4:G3 lip length ratio of 0.45. This structure has proved to be a preferred dimensioning for providing a reversal of the polarity of the net astigmatism of the G3–G4 lens, whereby to produce horizontal over-convergence to partially compensate for the vertical over-convergence provided by the yoke field. The center spot is, therefore, a vertically elongated ellipse with horizontal flare.

Experience has shown that the lip dimensions of the FIG. 5 Examples can vary by as much a about 7% without significantly changing the resultant astigmatism adjustment and beam spot shape.

FIG. 6 illustrates a modification of the novel electron gun 10, wherein a G4 is provided with a central tubular lip 46 which is shorter than the two outer lips 48. The purpose of this is to provide a more nearly equal astigmatism adjustment for the three electron beams. This is necessitated because, as shown in FIG. 2, the fringe field equipotential lines 42 and 44 have a greater curvature in the outer beam paths than they do in the central beam path. Thus, the net astigmatism of the G3 and G4 fringe fields is greater for the central beam than it is for the outer beams. By shortening the central G4 lip 46 the field lines 44 are given shallower curvature, thus more nearly equalizing the astigmatism for the three beams. Alternatively, the central one of the G3 lips 34 could be lengthened to obtain the same optimization.

GENERAL CONSIDERATIONS

The greatest advantage of the novel gun 10 is obtained when it is used in combination with the hereinbefore described self-converging yoke. In that combination the aperture lips 34 and 40 of the gun are adjusted to obtain a reversal of the gun's fringe field astigmatism so as to partially compensate for the yoke's vertical over-convergence astigmatism. Theoretically, one might consider increasing the vertical under-convergence of the gun's fringe field until the beam spot distortions were equal but of opposite polarity at the center and corner of the screen. However, in practice this is neither normally possible nor a design optimum. It is not normally possible because the astigmatism of a self-converging yoke is normally several times (perhaps 10–12 times) the astigmatism of the fringe fields of the focus lens, and thus the latter cannot be adjusted to completely compensate for the former. It is not a design optimum since less center than corner distortion is desired at the cost of greater corner distortion because the central zone of the screen is normally the critical viewing area. For this reason a design optimum or objective in this embodiment of the invention is not to even compensate to the maximum possible toward an equal and opposite condition, but to compensate for only about 10–25 percent of the corner astigmatism. To do so results in a center spot core whose elongated vertical dimension is less and its compressed horizontal dimension greater respectively than the elongated horizontal dimension and the compressed vertical dimension of the corner spot core.

In designing the absolute lengths of the G3 and G4 lips 34 and 40, it is usually desirable to make the G3 lips 34 as long as practical and then to adjust the lengths of the G4 lips accordingly. In practice the lips of the electrodes are extruded, and in normal extrusion processes these lips cannot easily be made longer than approximately one-half the diameter of the aperture from which they are extruded. In the embodiments described herein having an aperture diameter of about 5.5 millimeters, this means that the maximum practical length of the G3 lips will be approximately 2.75 millimeters. In actual practice, with this size aperture the G3 lips are made 2.54 mm long in order to provide a manufacturing tolerance. Having so established the length of the G3 lips 34, the G4 lips 40 are then made of appropriate length to give the desired balancing and/or cancellation of the astigmatism of the fringe field.

Experiments with various lip lengths of an electron gun having the electrodes dimensions described above, have shown that practical ratios of G4 to G3 lip length to provide useful adjustment of astigmatism lie within the range of 0.3 to 0.7. If the G4 lip is made less than about 0.3 times the G4 lip, the horizontal over-convergence is so severe as to produce an unacceptable distortion to the beam spot in the center of the screen. Conversely, if this ratio exceeds about 0.7, the astigmatism compensation is so small as to not even approach a balancing to zero astigmatism for the lens per se. Thus, no compensation for the astigmatism of the yoke is provided at all.

It is known that yoke astigmatism can be at least partially compensated for by novel structural design in the beam forming region of an electron gun, that is, in the region of the G1 and G2 electrodes. One example of such design is described in U.S. Pat. No. 4,234,814 issued to H. Y. Chen and R. H. Hughes on Nov. 18, 1980. In that patent the G2 electrode is provided with a horizontally extending slot on the G1 side thereof so as to produce an over-convergence in the horizontal plane and under-convergence in the vertical plane. This is designed to partially compensate for the over-convergence in the vertical plane provided by the yoke field. The present invention can be used with compensation structures such as that of the Chen-Hughes patent and can add to the compensation provided in the beam forming region to produce the desired amount of net compensation. When two such compensating mechanisms are combined, the degree of compensation required by either one is less than the total compensation desired.

What is claimed is:

1. In an in-line electron gun for use with an astigmatic self-converging magnetic deflection yoke located beyond an output end of said gun, said gun including two lens electrodes, by which an astigmatic electrostatic focus field is established in operation of said gun, each of said electrodes, including an elongated tub with 3 in-line apertures in the floor thereof facing the other of said electrodes, with each of said apertures of each of said electrodes having a tubular lip extending from the periphery of the aperture in a direction away from the other of said electrodes, said electrodes by virtue of their elongated tub shape producing the astigmatism in said focus field, the astigmatism of said yoke causing vertical overconvergence and horizontal underconvergence of the electron beams at maximum deflection of the yoke, the improvement comprising the lips of the lens electrode farthest from the output end of said gun having lengths that are less than half the diameter of their associated apertures and being longer than the corresponding lips of the other said lens electrode with the ratio of the lip length of the electrode nearest the output end of said gun to the lip length of the electrode farthest from said gun being in the range of 0.30 to 0.70 and being such as to make said astigmatism in said focus field of opposite polarity to that of said yoke to be of such value as to partially compensate for the yoke astigmatism at maximum beam deflection, and to produce electron beams at the output end of said gun which are vertically under-focused and horizontally over-focused.

2. The electron gun of claim 1 wherein the length of the center aperture lip of one of said electrodes is different from the lengths of its outer aperture lips, said difference being such as to provide greater astigmatism compensation for the center one of said beams than for the two outer ones of said beams.

3. The electron gun of claim 1 wherein the astigmatism of said focus field is over-converging in the in-line plane of said apertures by an amount to compensate about 10–25 percent of an over-converging astigmatism of the field of said yoke in the plane perpendicular to said in-line plane.

4. The electron gun of claim 3 wherein said ratio is about 0.45.

* * * * *